US005275343A

United States Patent [19]

Yamamoto et al.

[11] Patent Number: 5,275,343

[45] Date of Patent: Jan. 4, 1994

[54] YARN WINDING METHOD

[75] Inventors: Shigeru Yamamoto; Tutomu Ogiso; Takashi Ikeuchi, all of Matsuyama, Japan

[73] Assignee: Teijin Seiki Co., Ltd., Osaka, Japan

[21] Appl. No.: 880,593

[22] Filed: May 8, 1992

Related U.S. Application Data

[63] Continuation of Ser. No. 589,395, Sep. 27, 1990, Pat. No. 5,112,001.

[30] Foreign Application Priority Data

Sep. 30, 1989 [JP] Japan ..... 1-256320

[51] Int. Cl.[5] ..... B65H 54/32; B65H 54/38

[52] U.S. Cl. ..... 242/43 R; 242/18.1

[58] Field of Search ..... 242/43

[56] References Cited

U.S. PATENT DOCUMENTS 5,112,001 5/1992 Yamamoto et al. ..... 242/43 R

FOREIGN PATENT DOCUMENTS 63-123772 5/1988 Japan .

*Primary Examiner*—Stanley N. Gilreath

*Attorney, Agent, or Firm*—Rothwell, Figg, Ernst & Kurz

[57] ABSTRACT

A yarn winding method, which is applicable to a yarn winding device, which is installed in a texturing machine, a draw texturing machine, or a spinning machine, wherein traverse stroke is varied pulsatively, the traverse stroke, number of traverse strokes and winding speed are controlled by separate drive motors which are independent from each other, varying period of the traverse stroke, varying period of the number of traverse strokes and the varying period of the winding speed are basically in synchronism with each other, and at each traverse period, at least one of start points of the varying period of the traverse stroke, of varying period of the number of traverse strokes and of varying period of the winding speed is shifted from the other by a distance within a range of between 0 and 30% of the basic varying period.

4 Claims, 3 Drawing Sheets

FIG. 3
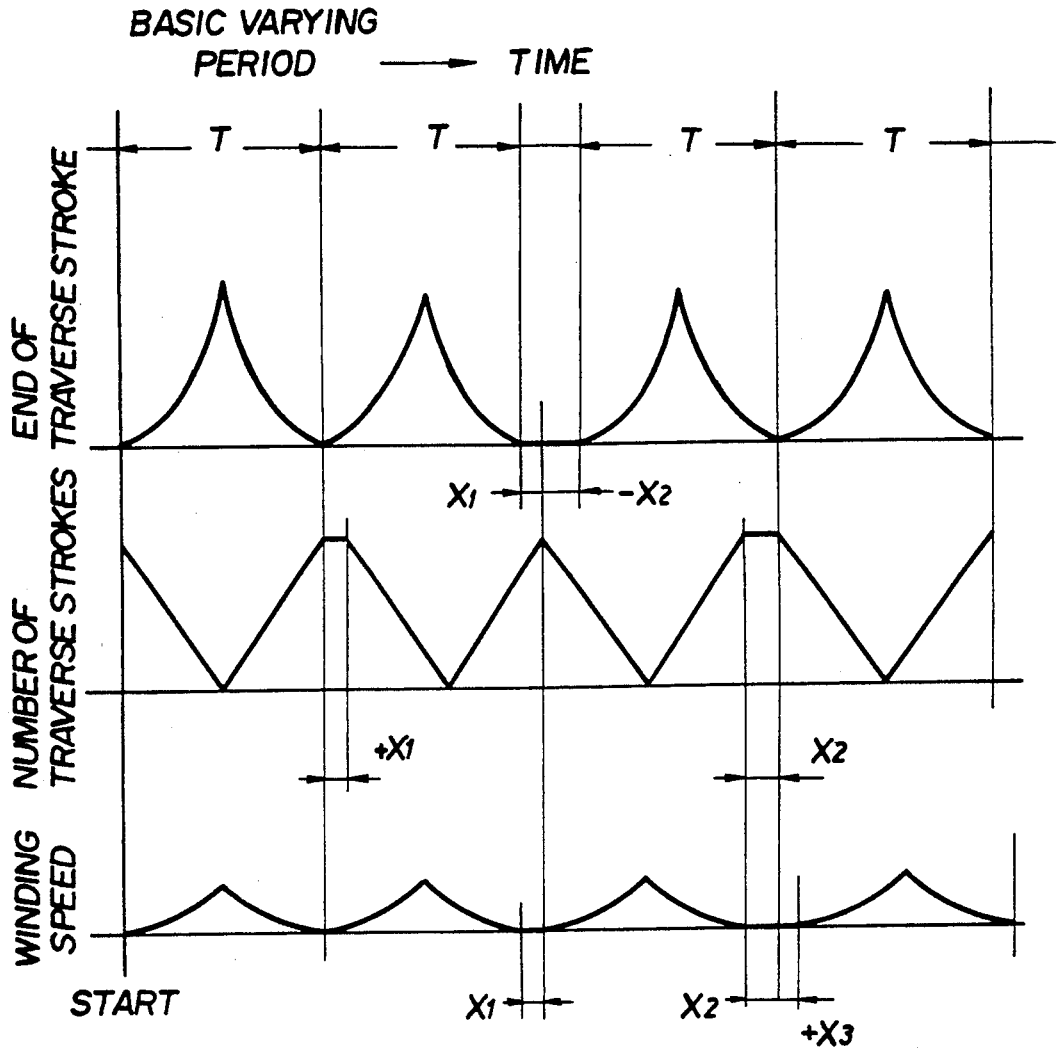
FIG. 4 (1)
FIG. 4 (2)
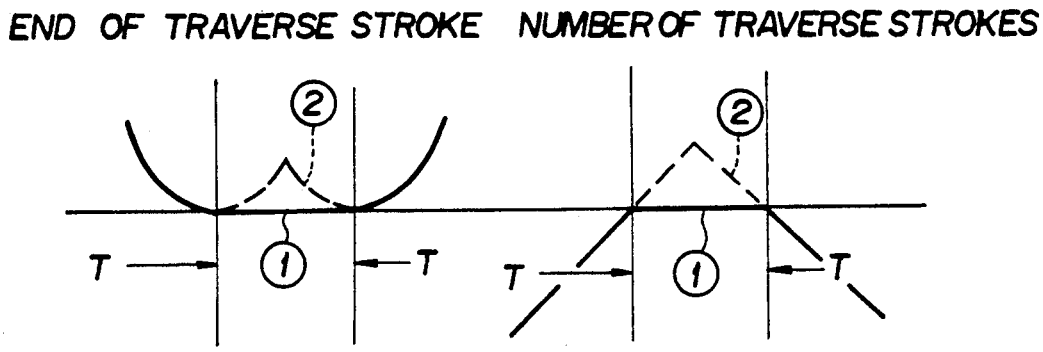

YARN WINDING METHOD

CROSS REFERENCE TO RELATED APPLICATION

This application is a continuation-in-part application of U.S. Ser. No. 07/589,395, filed on Sep. 27, 1990, now U.S. Pat. No. 5,112,001.

BACKGROUND OF THE INVENTION

The present invention relates to a yarn winding method, which can be carried out in a yarn winding device, for example, installed in a texturing machine, a draw texturing machine, or a spinning machine.

In a texturing machine or a spinning machine, a yarn is fed at a constant speed, and the thus fed yarn is wound to form a yarn package in a form of a straight cheese or a taper ended cheese. In such yarn winding machines, various winding methods have been proposed in order to maintain the tension in the yarn as constant as possible or to avoid formation of high shoulders or ribbon windings in the wound package.

For example, Japanese Patent Application Laid-open No. Sho 58-17066 proposes to pulsatively vary the traverse stroke so as to perform a so called creeping operation, while the traverse speed is also pulsatively varied at the same frequency as that of variation of the traverse stroke, and in addition, the time when the traverse speed is maximum and the time when the traverse stroke is minimum are made identical with each other while the time when the traverse speed is minimum and the time when the traverse stroke is maximum are also made identical with each other.

Further, Japanese Patent Publication No. Sho 61-38100 discloses that the winding speed is varied at a constant amplitude and at a constant period which is the same as the period of the traverse speed, while the traverse speed is varied at a constant amplitude and at a constant period upon winding a yarn at a substantially constant speed so as to minimize variation of tension in the yarn and to prevent formation of ribbon windings.

According to the conventional winding methods which have been proposed, there are various problems as set forth below, and the obtained yarn packages are unsatisfactory.

Even if the tension in the yarn being wound can be substantially constant, the yarn cannot be withdrawn at a high speed from the obtained package since high shoulders or ribbon windings may be formed in the wound package.

Contrary to this, should high shoulders or ribbon windings be prevented from being formed in the wound package, the tension in yarn cannot be constant.

Further, the proposed methods can be applied only to wind a yarn in a yarn package having a certain shape.

In addition, yarn quality or hardness of wound package obtained according to the proposed conventional methods may be influenced adversely.

More specifically, when a yarn is wound in the winding method disclosed in Japanese Patent Application Laid-open No. Sho 58-17066, though the tension in yarn may be substantially constant and occurrence of high shoulders may be prevented, the effect for preventing ribbon windings is insufficient depending on the relationships between the varying pattern of the traverse speed and the varying pattern of the traverse stroke since the changes in winding angle during winding operation are small, and accordingly, a yarn package which includes portions similar to ribbon windings may be obtained. When a yarn is withdrawn from a package including such portions similar to ribbon windings, the yarn wound at the portions cannot be smoothly withdrawn at a high speed, and therefore, operational efficiency becomes low.

When the winding speed is varied at a constant amplitude and a constant period which is the same as the period of the traverse speed while the traverse speed is varied at a constant amplitude and a constant period upon winding a yarn at a substantially constant speed as disclosed in Japanese Patent Publication No. Sho 61-38100, variation of tension in yarn can be decreased if an attempt for preventing formation of high shoulders is not carried out, i.e., the traverse stroke is not varied at all. However, when a yarn is wound while the traverse stroke is set completely constant as described above, there is a problem that high shoulders surely occur in the obtained yarn package. In order to prevent high shoulders, if a so called creeping operation is carried out, i.e., if the traverse stroke is varied periodically, there is another problem that the variation of tension in yarn during winding operation is enhanced.

OBJECTS OF THE INVENTION

It is an object of the present invention to provide a yarn winding method by which the problems inherent to the conventional methods can be at least minimized or completely obviated.

It is another object of the present invention to provide a yarn winding method by which a yarn package which is substantially free from high shoulders or ribbon windings can be obtained.

SUMMARY OF THE INVENTION

According to the present invention, the above-described objects are achieved by a method of winding a yarn onto a bobbin to form a wound package, comprising the steps of:

- traversing the yarn reciprocally across the bobbin through a traverse stroke while rotating the bobbin at a selected winding speed;
- varying the length of the traverse stroke according to a predetermined pattern having a basic time period T;
- varying the number of traverse strokes per unit of time according to a predetermined pattern having a basic period T;
- varying the winding speed according to a predetermined pattern having a basic time period T; and
- offsetting the starting points of the varying periods T for varying the length of the traverse stroke, varying the number of traverse strokes per unit of time and varying the winding speed from each other by a preselected interval.

According to the present invention, changes in winding angle can be enlarged since the start point of the varying period of the traverse stroke, the start point of the varying period of the number of traverse strokes and the start point of the varying point of the winding speed are shifted from each other by a distance within a range of between greater than 0% and 30% of the basic varying period while varying period of the traverse stroke, varying period of the number of traverse strokes and varying period of the winding speed are basically in synchronism with each other. As a result of large change in wind angle, possibility of overlap of yarn can be lowered, and accordingly, a yarn can be effectively withdrawn from the obtained yarn package.

Preferably, the length of the traverse stroke, the number of traverse strokes and the winding speed may be so controlled that the magnitude of a vector, a horizontal component of which is obtained by multiplying twice length of the transverse stroke by the number of traverse strokes and a vertical component of which is equal to the winding speed, is substantially constant.

BRIEF DESCRIPTION OF DRAWINGS

The present invention will now be described in detail with reference to the accompanying drawings, wherein:

FIG. 3 is a diagram illustrating the relationships between the variations in traverse stroke, number of traverse strokes and winding speed of the present invention;

FIGS. 4(1) and (2) are enlarged diagrams illustrating the condition between the adjacent periods of FIG. 3;

DETAILED DESCRIPTION OF THE INVENTION

Figure 1:
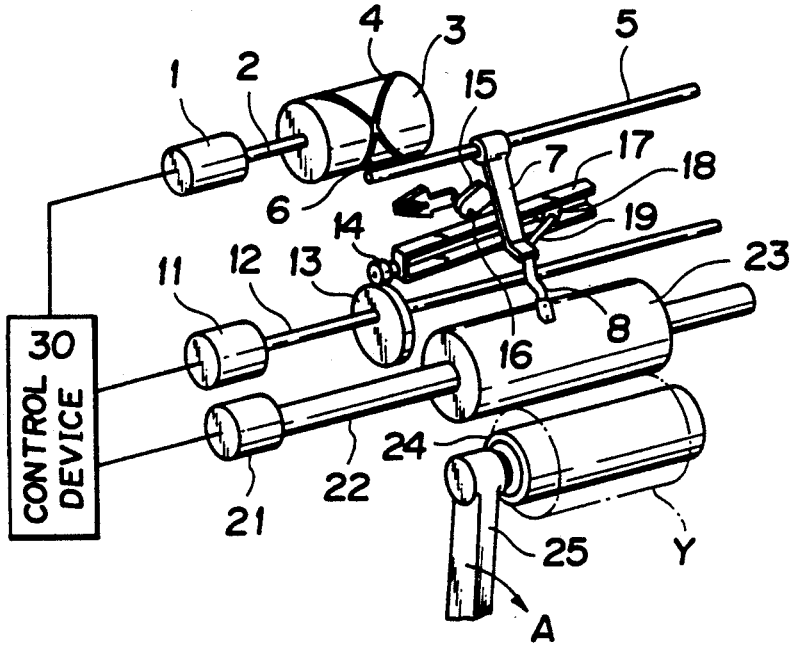
FIGS. 1 and 2 are perspective views of winding devices by which the winding method of the present invention is carried out.
Figure 2:
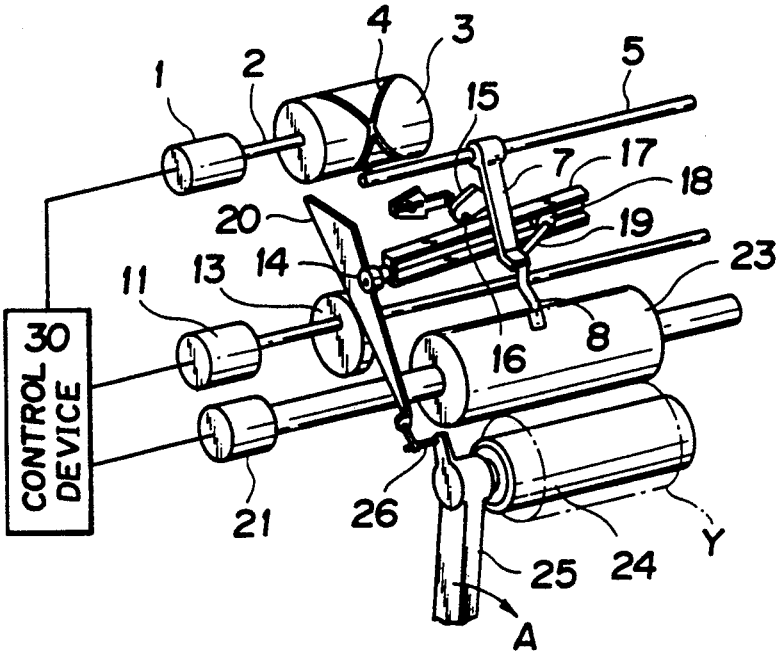

FIGS. 1 and 2 are perspective views of winding devices by which the winding method of the present invention can be carried out. Although a number of winding devices are installed in a lengthwise direction of the machine (not shown) as is common in a texturing machine or a spinning machine, only one of the devices is illustrated in FIGS. 1 and 2.

The winding device illustrated in FIG. 1 is suitable for winding a yarn package in a form of a straight cheese, and the winding device illustrated in FIG. 2 is suitable for winding a yarn package in a form of a taper ended cheese.

A motor 1 is a drive means for driving a traverse guide driving mechanism, and its rotational speed can be altered.

The traverse guide driving mechanism comprises: a cylindrical cam 3 having a cam groove 4 formed at the periphery thereof and connected to an output shaft 2 of the motor 1; a rod 5 movable in parallel with an axis of the cylindrical cam 3; a cam follower 6 connected to the rod 5 and engaging with the cam groove 4; and traverse guides 8 disposed at ends of arms 7 fixed to the rod 5.

Thus, the traverse guides 8 are reciprocated by the motor 1, and they traverse yarns to and fro. The number of traverse strokes per unit time, i.e., the reciprocating number of the traverse guides 8 in a unit time, for example, in one minute, can be varied by altering the rotational speed of the motor 1.

A motor 11 is a drive means for controlling a traverse stroke altering mechanism, and its rotational direction can be reversed, and further its rotational angle and rotational speed can also be altered.

The output shaft 12 of the motor 11 has a circular cam 13 mounted off-center thereto. A holder 15, which is fixed to the machine frame (not shown), swingably supports a swing shaft 16, to which a slider guide 17 is fixed. Sliders 18 slidably engage with the inner surface of the slider guide 17, and the sliders 18 are connected to the traverse guides 8 via links 19. The slider guide 17 has a cam follower 14 rotatably supported at an end thereof.

In the winding device illustrated in FIG. 1, the cam follower 14 is always in rolling contact with the outer periphery of the off-centered circular cam 13.

In the winding device illustrated in FIG. 2, a cam plate 20 formed in a substantially triangular shape is connected to an end of an arm 25, which supports a bobbin 24, via a pin 26, and the cam plate 20 is sandwiched between the cam follower 14 and the off-centered circular cam 13.

Accordingly, in the winding devices illustrated in FIGS. 1 and 2, when the off-centered circular cam 13 is rotated by the motor 11, the inclined angle of the slider guide 17 can be altered. As a result, the traverse stroke of the traverse guide 8 is altered. When the off-centered circular cam 13 is reciprocated in forward and reverse directions within a certain angular range, a creeping operation for preventing high shoulders takes place. More specifically, when the rotating speed or rotating angle of the motor 11 is altered, the traverse stroke can be altered in a desired creeping pattern as illustrated at upper portion of FIG. 3, where a line connecting ends of traverse strokes at one end of the traverse motion is illustrated.

Further, in the winding device illustrated in FIG. 2, as the package Y wound onto the bobbin 24 becomes large, the arm 25 gradually moves in a direction denoted by an arrow A. As a result, the inclined angle of the slider guide 17 is gradually altered. Accordingly, the traverse stroke is gradually decreased, and the package can be formed in a taper ended cheese.

A motor 21 is a drive means for driving a package driving mechanism, and its rotational speed can be altered. The package driving mechanism includes a friction roller 23 connected to the output shaft 22 of the motor 21. The bobbin 24 is rotatably supported between the ends of a pair of arms 25 which are swingable around their bases.

The friction roller 23 contacts the outer surface of the bobbin 24 or the yarn wound onto the bobbin 24 and rotates the bobbin 24. As the yarn package Y wound onto the bobbin 24 becomes large, the arms 25 swing in a direction denoted by an arrow A. The peripheral speed of the friction roller 23 or the package Y, i.e., the winding speed, can be altered by altering the rotating speed of the motor 21.

The motors 1, 11, and 21 can be independently rotated, and their rotations are controlled by a control device 30.

The control device 30 includes a computer and controls the motors 1, 11 and 21 so that the winding operation set forth below can be carried out and so that the tension in the yarn while it is wound is controlled substantially at a constant value. More specifically, the control device 30 controls the motors 1, 11 and 21 so that the magnitude of a vector, the horizontal component of which is obtained by multiplying twice length of the transverse stroke strokes by the number of traverse strokes and the vertical component of which is equal to the winding speed, is substantially constant.

If L stands for the length of traverse stroke, N stands for the number of traverse strokes and V stands for the winding speed, the substantial yarn winding speed becomes $$(V^2+(2L\times N)^2)^{\frac{1}{2}}$$

since the yarn traversing speed is $2L \times N$. In order to control the tension in the yarn substantially constant, the length of the traverse stroke, the number of traverse strokes and the winding speed are so controlled that the value $(V^2+(2L \times N)^2)^{\frac{1}{2}}$ substantially becomes constant.

FIG. 3 is a diagram of an embodiment of the yarn winding method of the present invention.

At the upper portion in FIG. 3, time is plotted on abscissa and traverse stroke is plotted on ordinate. More specifically, although a number of traverse motions are repeated, the traverse motion per se is not illustrated in FIG. 3, and in place of the traverse motions, a line connecting ends of traverse strokes at one end of the traverse motions is illustrated at the upper portion in FIG. 3 to show a creeping pattern. Such creeping pattern as illustrated at the upper portion in FIG. 3 repeats, and it shows a certain varying period.

Similarly, at the central portion in FIG. 3, time is plotted on abscissa and number of traverse strokes, i.e., the number of traverse strokes in a unit time, is plotted on ordinate. More specifically, although a number of traverse motions are repeated, the traverse motion per se is not illustrated in FIG. 3, and in place of the traverse motions, a line connecting numbers of traverse strokes for the traverse motions is illustrated at the central portion in FIG. 3 to show a variation of the number of traverse strokes. Such pattern of variation of number of traverse strokes as illustrated at the central portion in FIG. 3 also repeats, and it shows a certain varying period.

Further, at the lower portion in FIG. 3, time is plotted on abscissa and the winding speed is plotted on ordinate. Such pattern of variation of the winding speed as illustrated at the lower portion in FIG. 3 also repeats, and it shows a certain varying period.

In FIG. 3, the start timings of the creeping motion, i.e., the start timings of the varying period of the traverse stroke, of the varying period of the number of traverse strokes and of the varying period of the winding speed are varied at each period while the basic period T of the varying period of the traverse stroke, of the varying period of the number of the traverse strokes and of the varying period of the winding speed are set constant.

More specifically, when the start of the varying period of the number of traverse strokes or of the winding speed is delayed compared to that of the creeping motion, it is expressed by "+", and contrary to this, when the former is advanced compared to the latter, it is expressed by "−". In FIG. 3, after start, in the first period, the varying period of the traverse stroke, that of the number of traverse strokes and that of the winding speed are corresponding to each other while the increase and the decrease of the number of traverse strokes are opposite to those of the creeping motion or the winding speed. In the second period, there is observed a shift +X1 in the number of traverse strokes. Further, in the fourth period, there is observed a shift +X3 in the winding speed.

In the time interval where the periods are shifted, i.e., the time interval X1 between the first and second periods, and the time interval X1+X2 between the second and third period and so on, the variation of the creeping operation or the variation of the number of traverse strokes may be stopped as illustrated by solid lines in FIGS. 4(1) and 4(2), or may be varied as illustrated by broken lines in FIGS. 4(1) and 4(2). Similarly, the variation of the winding speed may be stopped or varied in a manner similar to that of the variation of the creeping operation or the variation of the number of traverse strokes illustrated in FIG. 4(1) or 4(2).

The term "varying period" in this specification means the time interval between the start point of increase or decrease and the next start point of increase or decrease in an increasing or decreasing varying pattern.

It is preferred that the amount of the shift X1, X2 or X3 of the start of the varying periods is set in a range between −30% and +30% of the basic varying period T. The amounts of the shift X1, X2 or X3 in the varying periods are distributed by using a table of random numbers or by using psuedo-random numbers so as to diminish a regularity of the amounts of shift, or in some cases, the amounts set in a regularity may be used.

Figure 5:
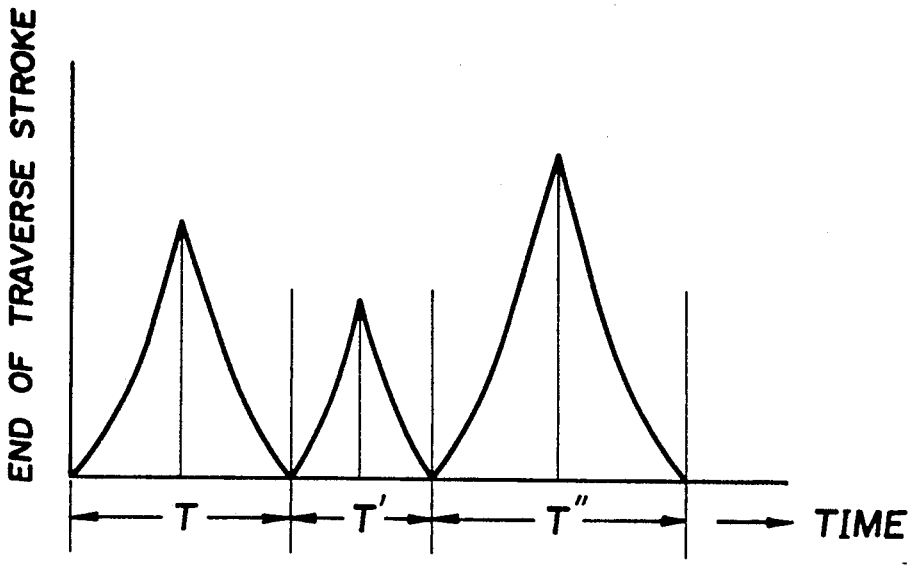
FIG. 5 is a diagram illustrating the variation in traverse stroke according to another embodiment of the present invention.

In the above-described embodiment, the basic varying periods T for the various varying periods are set identical, i.e., they are constant if they are observed along the ordinate of time. However, the present invention is also applicable when the periods T, T′, T″ are varied as illustrated in FIG. 5. Although the varying periods of the traverse stroke, i.e., the varying periods of creeping operation, are varied as T, T′ and T″ in FIG. 5, the varying periods of the number of traverse strokes may be varied as T, T′ and T″, and similarly, the varying periods of the winding speed may be varied as T, T′ and T″.

As described above, it is preferred that the varying amount of the traverse stroke and the varying amount of the number of traverse strokes are so controlled that magnitude of a vector, composed of the horizontal vector, obtained by multiplying the double of the length of the traverse stroke with the number of traverse strokes, and the vertical vector in the winding speed, is almost constant.

Thus, one of the varying periods of traverse stroke, number of traverse strokes and winding speed is shifted, and the variation in tension in winding yarn which is caused by the shift of the period can be compensated by the other element, and accordingly, there is an advantage that the variation of tension in winding yarn can be minimized.

According to the winding method of the present invention, as a result of large change in wind angle, possibility of overlap of yarn can be lowered.

Figure 6:
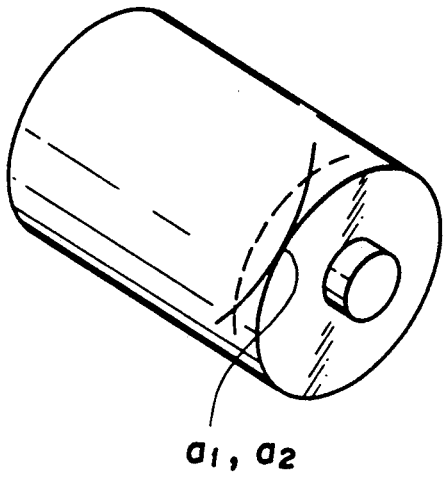
FIG. 6 is a perspective view of a yarn package.

For example, in a yarn package P illustrated in FIG. 6, if the basic varying period T is kept constant, there occurs a case wherein points a1 and a2 are overlapped at a certain diameter D. In this case, the yarn is overlapped not only at points a1 and a2 but also is wound onto the package drawing the same locus as the previous one during the varying period. Further, the diameter of the yarn package increases gradually, the yarn is wound along the same locus for several periods.

Contrary to this, the present invention substantially corresponds to vary the varying period of the traverse stroke and the varying period of the number of traverse strokes. Should the points a1 and a2 be overlapped at a certain period, the points may be transferred to other points. Further, the change in wind angle in a single period is different in each varying period, the yarn is wound onto a yarn package along a locus which is different from the previous one.

Accordingly, a yarn package from which the yarn can be smoothly withdrawn can be obtained according to the present invention.

What is claimed is:

1. A method of winding a yarn onto a bobbin to form a wound package, comprising the steps of:

traversing said yarn reciprocally across said bobbin through a traverse stroke while rotating said bobbin at a selected winding speed;

varying the length of said traverse stroke according to a predetermined pattern having a basic time period T;

varying the number of traverse strokes per unit of time according to a predetermined pattern having a basic time period T;

varying said winding speed according to a predetermined pattern having a basic time period T; and offsetting the starting points of the varying periods T for varying the length of said traverse stroke, varying the number of traverse strokes per unit of time, and varying the winding speed from each other by a preselected interval;

wherein the basic time periods T are equal to each other, and wherein the step of offsetting comprises temporarily stopping variation of one traverse stroke according to the predetermined pattern for a predetermined amount of time.

2. The method of claim 1, wherein the length of said traverse stroke, the number of traverse strokes and said winding speed are so controlled that the magnitude of a vector, a horizontal component of which is obtained by multiplying twice the length of said traverse stroke by said number of traverse strokes and a vertical component of which is equal to said winding speed, is substantially constant.

3. The method of claim 1, wherein said preselected interval varies in the range of greater than 0% to 30% of the basic time period T.

4. The method of claim 1, wherein said preselected interval is set in the rang of greater than 0% to 30% of the basic time period T.

* * * * *

UNITED STATES PATENT AND TRADEMARK OFFICE

CERTIFICATE OF CORRECTION

PATENT NO. : 5,275,343

DATED : January 4, 1994

INVENTOR(S) : Shigeru Yamamoto et al.

It is certified that error appears in the above-identified patent and that said Letters Patent is hereby corrected as shown below:

Col. 4, line 59, delete "strokes".

Signed and Sealed this

Seventh Day of June, 1994

Bruce Lehman

*Attest:*

BRUCE LEHMAN

*Attesting Officer*

*Commissioner of Patents and Trademarks*